US005563013A

United States Patent [19]

Tam

[11] Patent Number: 5,563,013

[45] Date of Patent: Oct. 8, 1996

[54] PRE-SENSITIZED INFRARED OR RED LIGHT SENSITIVE MIGRATION IMAGING MEMBERS

[75] Inventor: Man C. Tam, Mississauga, Ontario, Canada

[73] Assignee: Xerox Corporation, Stamford, Conn.

[21] Appl. No.: 432,401

[22] Filed: May 1, 1995

[51] Int. Cl.[6] ..... G03G 13/04

[52] U.S. Cl. ..... 430/41; 430/130

[58] Field of Search ..... 430/41, 130

[56] References Cited

U.S. PATENT DOCUMENTS

| | | | |
|---|---|---|---|
| 3,909,262 | 9/1975 | Goffe et al. | 96/1.5 |
| 4,135,926 | 1/1979 | Belli | 430/41 |
| 4,536,457 | 8/1985 | Tam | 430/41 |
| 4,536,458 | 8/1985 | Ng | 430/41 |
| 5,102,756 | 4/1992 | Vinett et al. | 430/41 |
| 5,215,838 | 6/1993 | Tam et al. | 430/41 |

*Primary Examiner*—Christopher D. Rodee
*Attorney, Agent, or Firm*—Judith L. Byorick

[57] ABSTRACT

Disclosed is a process which comprises (1) providing a migration imaging member comprising a substrate, an infrared or red light radiation sensitive layer comprising a pigment predominantly sensitive to infrared or red light radiation, and a softenable layer comprising a softenable material, a charge transport material, and migration marking material predominantly sensitive to radiation at a wavelength other than that to which the infrared or red light sensitive pigment is predominantly sensitive contained at or near the surface of the softenable layer, said infrared or red light radiation sensitive layer being situated between the substrate and the softenable layer; (2) uniformly charging the imaging member; (3) subsequent to step (2), uniformly exposing the imaging member to activating radiation at a wavelength to which the migration marking material is sensitive; (4) subsequent to step (3), neutralizing charge on the surface of the imaging member spaced from the substrate; (5) subsequent to step (4), exposing the imaging member to infrared or red light radiation at a wavelength to which the infrared or red light radiation sensitive pigment is sensitive in an imagewise pattern, thereby forming an electrostatic latent image on the imaging member, wherein step (5) takes place at least 2 hours after completion of step (4); (6) subsequent to step (5), causing the softenable material to soften, thereby enabling the migration marking material to migrate through the softenable material toward the substrate in an imagewise pattern.

12 Claims, 5 Drawing Sheets

PRE-SENSITIZED INFRARED OR RED LIGHT SENSITIVE MIGRATION IMAGING MEMBERS

BACKGROUND OF THE INVENTION

The present invention is directed to a process for sensitizing a migration imaging member capable of being imaged by exposure to infrared or red light radiation. More specifically, the present invention is directed to a process for pre-sensitizing an infrared or red light sensitive migration imaging member wherein the sensitizing charge is stable in the imaging member for long periods of time, thus enabling the migration imaging member to retain its imaging sensitivity for long periods of time. One embodiment of the present invention is directed to a process which comprises (1) providing a migration imaging member comprising a substrate, an infrared or red light radiation sensitive layer comprising a pigment predominantly sensitive to infrared or red light radiation, and a softenable layer comprising a softenable material, a charge transport material, and migration marking material predominantly sensitive to radiation at a wavelength other than that to which the infrared or red light sensitive pigment is predominantly sensitive contained at or near the surface of the softenable layer, said infrared or red light radiation sensitive layer being situated between the substrate and the softenable layer; (2) uniformly charging the imaging member; (3) subsequent to step (2), uniformly exposing the imaging member to activating radiation at a wavelength to which the migration marking material is sensitive; (4) subsequent to step (3), neutralizing charge on the surface of the imaging member spaced from the substrate; (5) subsequent to step (4), exposing the imaging member to infrared or red light radiation at a wavelength to which the infrared or red light radiation sensitive pigment is sensitive in an imagewise pattern, thereby forming an electrostatic latent image on the imaging member, wherein step (5) takes place at least 2 hours after completion of step (4); (6) subsequent to step (5), causing the softenable material to soften, thereby enabling the migration marking material to migrate through the softenable material toward the substrate in an imagewise pattern.

Migration imaging systems capable of producing high quality images of high optical contrast density and high resolution have been developed. Such migration imaging systems are disclosed in, for example, U.S. Pat. Nos. 5,215,838, 5,202,206, 5,102,756, 5,021,308, 4,970,130, 4,937,163, 4,883,731, 4,880,715, 4,853,307, 4,536,458, 4,536,457, 4,496,642, 4,482,622, 4,281,050, 4,252,890, 4,241,156, 4,230,782, 4,157,259, 4,135,926, 4,123,283, 4,102,682, 4,101,321, 4,084,966, 4,081,273, 4,078,923, 4,072,517, 4,065,307, 4,062,680, 4,055,418, 4,040,826, 4,029,502, 4,028,101, 4,014,695, 4,013,462, 4,012,250, 4,009,028, 4,007,042, 3,998,635, 3,985,560, 3,982,939, 3,982,936, 3,979,210, 3,976,483, 3,975,739, 3,975,195, and 3,909,262, the disclosures of each of which are totally incorporated herein by reference, and in "Migration Imaging Mechanisms, Exploitation, and Future Prospects of Unique Photographic Technologies, XDM and AMEN", P. S. Vincett, G. J. Kovacs, M. C. Tam, A. L. Pundsack, and P. H. Soden, *Journal of Imaging Science* 30 (4) July/August, pp. 183–191 (1986), the disclosure of which is totally incorporated herein by reference.

The expression "softenable" as used herein is intended to mean any material which can be rendered more permeable, thereby enabling particles to migrate through its bulk. Conventionally, changing the permeability of such material or reducing its resistance to migration of migration marking material is accomplished by dissolving, swelling, melting, or softening, by techniques, for example, such as contacting with heat, vapors, partial solvents, solvent vapors, solvents, and combinations thereof, or by otherwise reducing the viscosity of the softenable material by any suitable means.

The expression "fracturable" layer or material as used herein means any layer or material which is capable of breaking up during development, thereby permitting portions of the layer to migrate toward the substrate or to be otherwise removed. The fracturable layer is preferably particulate in the various embodiments of the migration imaging members. Such fracturable layers of marking material are typically contiguous to the surface of the softenable layer spaced apart from the substrate, and such fracturable layers can be substantially or wholly embedded in the softenable layer in various embodiments of the imaging members.

The expression "contiguous" as used herein is intended to mean in actual contact, touching, also, near, though not in contact, and adjoining, and is intended to describe generically the relationship of the fracturable layer of marking material in the softenable layer with the surface of the softenable layer spaced apart from the substrate.

The expression "optically sign-retained" as used herein is intended to mean that the dark (higher optical density) and light (lower optical density) areas of the visible image formed on the migration imaging member correspond to the dark and light areas of the illuminating electromagnetic radiation pattern.

The expression "optically sign-reversed" as used herein is intended to mean that the dark areas of the image formed on the migration imaging member correspond to the light areas of the illuminating electromagnetic radiation pattern and the light areas of the image formed on the migration imaging member correspond to the dark areas of the illuminating electromagnetic radiation pattern.

The expression "optical contrast density" as used herein is intended to mean the difference between maximum optical density ($D_{max}$) and minimum optical density ($D_{min}$) of an image. Optical density is measured for the purpose of this invention by diffuse densitometers with a blue Wratten No. 94 filter. The expression "optical density" as used herein is intended to mean "transmission optical density" and is represented by the formula:

$$D=\log_{10}[I_o/I]$$

where I is the transmitted light intensity and $I_o$ is the incident light intensity. For the purpose of this invention, all values of transmission optical density given in this invention include the substrate density of about 0.2 which is the typical density of a metallized polyester substrate.

High optical density in migration imaging members allows high contrast densities in migration images made from the migration imaging members. High contrast density is highly desirable for most information storage systems. Contrast density is used herein to denote the difference between maximum and minimum optical density in a migration image. The maximum optical density value of an imaged migration imaging member is, of course, the same value as the optical density of an unimaged migration imaging member.

There are various other systems for forming such images, wherein non-photosensitive or inert marking materials are arranged in the aforementioned fracturable layers, or dispersed throughout the softenable layer, as described in the aforementioned patents, which also disclose a variety of methods which can be used to form latent images upon migration imaging members.

Various means for developing the latent images can be used for migration imaging systems. These development methods include solvent wash away, solvent vapor softening, heat softening, and combinations of these methods, as well as any other method which changes the resistance of the softenable material to the migration of particulate marking material through the softenable layer to allow imagewise migration of the particles in depth toward the substrate. In the solvent wash away or meniscus development method, the migration marking material in the light struck region migrates toward the substrate through the softenable layer, which is softened and dissolved, and repacks into a more or less monolayer configuration. In migration imaging films supported by transparent substrates alone, this region exhibits a maximum optical density which can be as high as the initial optical density of the unprocessed film. On the other hand, the migration marking material in the unexposed region is substantially washed away and this region exhibits a minimum optical density which is essentially the optical density of the substrate alone. Therefore, the image sense of the developed image is optically sign reversed. Various methods and materials and combinations thereof have previously been used to fix such unfixed migration images. One method is to overcoat the image with a transparent abrasion resistant polymer by solution coating techniques. In the heat or vapor softening developing modes, the migration marking material in the light struck region disperses in the depth of the softenable layer after development and this region exhibits $D_{min}$ which is typically in the range of 0.6 to 0.7. This relatively high $D_{min}$ is a direct consequence of the depthwise dispersion of the otherwise unchanged migration marking material. On the other hand, the migration marking material in the unexposed region does not migrate and substantially remains in the original configuration, i.e. a monolayer. In migration imaging films supported by transparent substrates, this region exhibits a maximum optical density ($D_{max}$) of about 1.8 to 1.9. Therefore, the image sense of the heat or vapor developed images is optically sign-retained.

Techniques have been devised to permit optically sign-reversed imaging with vapor development, but these techniques are generally complex and require critically controlled processing conditions. An example of such techniques can be found in U.S. Pat. No. 3,795,512, the disclosure of which is totally incorporated herein by reference.

For many imaging applications, it is desirable to produce negative images from a positive original or positive images from a negative original (optically sign-reversing imaging), preferably with low minimum optical density. Although the meniscus or solvent wash away development method produces optically sign-reversed images with low minimum optical density, it entails removal of materials from the migration imaging member, leaving the migration image largely or totally unprotected from abrasion. Although various methods and materials have previously been used to overcoat such unfixed migration images, the post-development overcoating step can be impractically costly and inconvenient for the end users. Additionally, disposal of the effluents washed from the migration imaging member during development can also be very costly.

The background portions of an imaged member can sometimes be transparentized by means of an agglomeration and coalescence effect. In this system, an imaging member comprising a softenable layer containing a fracturable layer of electrically photosensitive migration marking material is imaged in one process mode by electrostatically charging the member, exposing the member to an imagewise pattern of activating electromagnetic radiation, and softening the softenable layer by exposure for a few seconds to a solvent vapor thereby causing a selective migration in depth of the migration material in the softenable layer in the areas which were previously exposed to the activating radiation. The vapor developed image is then subjected to a heating step. Since the exposed particles gain a substantial net charge (typically 85 to 90 percent of the deposited surface charge) as a result of light exposure, they migrate substantially in depth in the softenable layer towards the substrate when exposed to a solvent vapor, thus causing a drastic reduction in optical density. The optical density in this region is typically in the region of 0.7 to 0.9 (including the substrate density of about 0.2) after vapor exposure, compared with an initial value of 1.8 to 1.9 (including the substrate density of about 0.2). In the unexposed region, the surface charge becomes discharged due to vapor exposure. The subsequent heating step causes the unmigrated, uncharged migration material in unexposed areas to agglomerate or flocculate, often accompanied by coalescence of the marking material particles, thereby resulting in a migration image of very low minimum optical density (in the unexposed areas) in the 0.25 to 0.35 range. Thus, the contrast density of the final image is typically in the range of 0.35 to 0.65. Alternatively, the migration image can be formed by heat followed by exposure to solvent vapors and a second heating step which also results in a migration image with very low minimum optical density. In this imaging system as well as in the previously described heat or vapor development techniques, the softenable layer remains substantially intact after development, with the image being self-fixed because the marking material particles are trapped within the softenable layer.

The word "agglomeration" as used herein is defined as the coming together and adhering of previously substantially separate particles, without the loss of identity of the particles.

The word "coalescence" as used herein is defined as the fusing together of such particles into larger units, usually accompanied by a change of shape of the coalesced particles towards a shape of lower energy, such as a sphere.

Generally, the softenable layer of migration imaging members is characterized by sensitivity to abrasion and foreign contaminants. Since a fracturable layer is located at or close to the surface of the softenable layer, abrasion can readily remove some of the fracturable layer during either manufacturing or use of the imaging member and adversely affect the final image. Foreign contamination such as finger prints can also cause defects to appear in any final image. Moreover, the softenable layer tends to cause blocking of migration imaging members when multiple members are stacked or when the migration imaging material is wound into rolls for storage or transportation. Blocking is the adhesion of adjacent objects to each other. Blocking usually results in damage to the objects when they are separated.

The sensitivity to abrasion and foreign contaminants can be reduced by forming an overcoating such as the overcoatings described in U.S. Pat. No. 3,909,262, the disclosure of which is totally incorporated herein by reference. However, because the migration imaging mechanisms for each development method are different and because they depend critically on the electrical properties of the surface of the softenable layer and on the complex interplay of the various electrical processes involving charge injection from the surface, charge transport through the softenable layer, charge capture by the photosensitive particles and charge ejection from the photosensitive particles, and the like, application of an overcoat to the softenable layer can cause changes in the delicate balance of these processes and result in degraded photographic characteristics compared with the non-overcoated migration imaging member. Notably, the photographic contrast density can degraded. Recently, improvements in migration imaging members and processes for forming images on these migration imaging members have been achieved. These improved migration imaging members and processes are described in U.S. Pat. Nos. 4,536,458 and 4,536,457.

Migration imaging members are also suitable for use as masks for exposing the photosensitive material in a printing plate. The migration imaging member can be laid on the plate prior to exposure to radiation, or the migration imaging member layers can be coated or laminated onto the printing plate itself prior to exposure to radiation, and removed subsequent to exposure.

U.S. Pat. No. 5,102,756 (Vincett et al.), the disclosure of which is totally incorporated herein by reference, discloses a printing plate precursor which comprises a base layer, a layer of photohardenable material, and a layer of softenable material containing photosensitive migration marking material. Alternatively, the precursor can comprise a base layer and a layer of softenable photohardenable material containing photosensitive migration marking material. Also disclosed are processes for preparing printing plates from the disclosed precursors.

U.S. Pat. No. 5,215,838 (Tam et al.), the disclosure of which is totally incorporated herein by reference, discloses a migration imaging member comprising a substrate, an infrared or red light radiation sensitive layer comprising a pigment predominantly sensitive to infrared or red light radiation, and a softenable layer comprising a softenable material, a charge transport material, and migration marking material predominantly sensitive to radiation at a wavelength other than that to which the infrared or red light radiation sensitive pigment is sensitive contained at or near the surface of the softenable layer. When the migration imaging member is imaged and developed, it is particularly suitable for use as a xeroprinting master and can also be used for viewing or for storing data.

Application U.S. Ser. No. 08/413,667, filed Mar. 30, 1995, now U.S. Pat. No. 5,532,102 entitled "Improved Apparatus and Process for Preparation of Migration Imaging Members," with the named inventors Philip H. Soden and Arnold L. Pundsack, the disclosure of which is totally incorporated herein by reference, discloses an apparatus for evaporation of a vacuum evaporatable material onto a substrate, said apparatus comprising (a) a walled container for the vacuum evaporatable material having a plurality of apertures in a surface thereof, said apertures being configured so that the vacuum evaporatable material is uniformly deposited onto the substrate; and (b) a source of heat sufficient to effect evaporation of the vacuum evaporatable material from the container through the apertures onto the substrate, wherein the surface of the container having the plurality of apertures therein is maintained at a temperature equal to or greater than the temperature of the vacuum evaporatable material.

While known apparatus and processes are suitable for their intended purposes, a need remains for improved processes for imaging infrared or red light sensitive migration imaging members. There is also a need for processes for imaging infrared or red light sensitive migration imaging members in imaging apparatus designed for imaging silver halide films without the need to modify the imaging apparatus. Further, there is a need for processes for presensitizing infrared or red light sensitive migration imaging members. In addition, a need remains for processes for presensitizing infrared or red light sensitive migration imaging members wherein the sensitizing charge within the imaging member is stable for long periods of time. There is also a need for processes for presensitizing infrared or red light sensitive migration imaging members which can be carried out by the manufacturer prior to delivery of the imaging member to the customer. Further, there is a need for processes for presensitizing infrared or red light sensitive migration imaging members which can be carried out by the customer in a presensitizing apparatus separate from the imaging apparatus prior to imaging. Additionally, a need remains for processes for presensitizing infrared or red light sensitive migration imaging members which enable handling of the presensitized film without detriment to its subsequent image formation abilities. A need also remains for processes for presensitizing infrared or red light sensitive migration imaging members which enable rolling the presensitized film into rolls or stacking the presensitized film into cut sheets during manufacturing or storage without detriment to its subsequent image formation abilities.

SUMMARY OF THE INVENTION

It is an object of the present invention to provide migration imaging processes with the above noted advantages.

It is another object of the present invention to provide improved processes for imaging infrared or red light sensitive migration imaging members.

It is yet another object of the present invention to provide processes for imaging infrared or red light sensitive migration imaging members in imaging apparatus designed for imaging silver halide films without the need to modify the imaging apparatus.

It is still another object of the present invention to provide processes for presensitizing infrared or red light sensitive migration imaging members.

Another object of the present invention is to provide processes for presensitizing infrared or red light sensitive migration imaging members wherein the sensitizing charge within the imaging member is stable for long periods of time.

Yet another object of the present invention is to provide processes for presensitizing infrared or red light sensitive migration imaging members which can be carried out by the manufacturer prior to delivery of the imaging member to the customer.

Still another object of the present invention is to provide processes for presensitizing infrared or red light sensitive migration imaging members which can be carried out by the customer in a presensitizing apparatus separate from the imaging apparatus prior to imaging.

It is another object of the present invention to provide processes for presensitizing infrared or red light sensitive migration imaging members which enable handling of the presensitized film without detriment to its subsequent image formation abilities.

It is yet another object of the present invention to provide processes for presensitizing infrared or red light sensitive migration imaging members which enable rolling the presensitized film into rolls or stacking the presensitized film into cut sheets during manufacturing or storage without detriment to its subsequent image formation abilities.

These and other objects of the present invention (or specific embodiments thereof) can be achieved by providing a process which comprises (1) providing a migration imaging member comprising a substrate, an infrared or red light radiation sensitive layer comprising a pigment predominantly sensitive to infrared or red light radiation, and a softenable layer comprising a softenable material, a charge transport material, and migration marking material predominantly sensitive to radiation at a wavelength other than that to which the infrared or red light sensitive pigment is predominantly sensitive contained at or near the surface of the softenable layer, said infrared or red light radiation sensitive layer being situated between the substrate and the softenable layer; (2) uniformly charging the imaging member; (3) subsequent to step (2), uniformly exposing the imaging member to activating radiation at a wavelength to which the migration marking material is sensitive; (4) subsequent to step (3), neutralizing charge on the surface of the imaging member spaced from the substrate; (5) subsequent to step (4), exposing the imaging member to infrared or red light radiation at a wavelength to which the infrared or red light radiation sensitive pigment is sensitive in an imagewise pattern, thereby forming an electrostatic latent image on the imaging member, wherein step (5) takes place at least 2 hours after completion of step (4); (6) subsequent to step (5), causing the softenable material to soften, thereby enabling the migration marking material to migrate through the softenable material toward the substrate in an imagewise pattern.

DETAILED DESCRIPTION OF THE INVENTION

The present invention encompasses a process wherein an infrared or red light sensitive migration imaging member is uniformly charged and uniformly exposed to activating radiation at a wavelength to which the migration marking material is sensitive, followed by neutralizing charge on the surface of the imaging member. Thereafter, the migration imaging member thus pre-sensitized is exposed to infrared or red light radiation at a wavelength to which the infrared or red light radiation sensitive pigment is sensitive in an imagewise pattern to form an electrostatic latent image on the imaging member, followed by causing the softenable material to soften, thereby enabling the migration marking material to migrate through the softenable material toward the substrate in an imagewise pattern.

Figure 1:
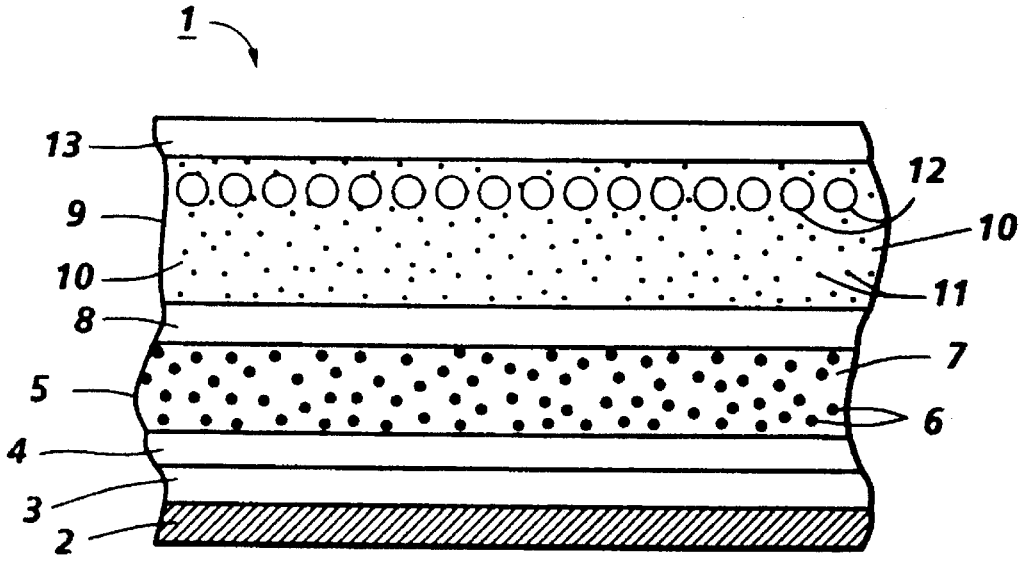
FIG. 1 illustrates schematically a migration imaging member suitable for the present invention.

An example of a migration imaging member suitable for the present invention is illustrated schematically in FIG. 1. As illustrated schematically in FIG. 1, migration imaging member 1 comprises in the order shown a substrate 2, an optional adhesive layer 3 situated on substrate 2, an optional charge blocking layer 4 situated on optional adhesive layer 3, an infrared or red light radiation sensitive layer 5 situated on optional charge blocking layer 4 comprising infrared or red light radiation sensitive pigment particles 6 optionally dispersed in polymeric binder 7, an optional charge transport layer 8 situated on infrared or red light radiation sensitive layer 5, and a softenable layer 9 situated on optional charge transport layer 8, said softenable layer 9 comprising softenable material 10, charge transport material 11, and migration marking material 12 situated at or near the surface of the layer spaced from the substrate. Optional overcoating layer 13 is situated on the surface of imaging member 1 spaced from the substrate 2. Any or all of the optional layers and materials can be absent from the imaging member. In addition, any of the optional layers present need not be in the order shown, but can be in any suitable arrangement. The migration imaging member can be in any suitable configuration, such as a web, a foil, a laminate, a strip, a sheet, a coil, a cylinder, a drum, an endless belt, an endless mobius strip, a circular disc, or any other suitable form.

The substrate can be either electrically conductive or electrically insulating. When conductive, the substrate can be opaque, translucent, semitransparent, or transparent, and can be of any suitable conductive material, including copper, brass, nickel, zinc, chromium, stainless steel, conductive plastics and rubbers, aluminum, semitransparent aluminum, steel, cadmium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. When insulative, the substrate can be opaque, translucent, semitransparent, or transparent, and can be of any suitable insulative material, such as paper, glass, plastic, polyesters such as Mylar® (available from Du Pont) or Melinex® 442 (available from ICI Americas, Inc.), and the like. In addition, the substrate can comprise an insulative layer with a conductive coating, such as vacuum-deposited metallized plastic, such as titanized or aluminized Mylar® polyester, wherein the metallized surface is in contact with the softenable layer or any other layer situated between the substrate and the softenable layer. The substrate has any effective thickness, typically from about 6 to about 250 microns, and preferably from about 50 to about 200 microns, although the thickness can be outside these ranges.

The softenable layer can comprise one or more layers of softenable materials, which can be any suitable material, typically a plastic or thermoplastic material which is soluble in a solvent or softenable, for example, in a solvent liquid, solvent vapor, heat, or any combinations thereof. When the softenable layer is to be softened or dissolved either during or after imaging, it should be soluble in a solvent that does not attack the migration marking material. By softenable is meant any material that can be rendered by a development step as described herein permeable to migration material migrating through its bulk. This permeability typically is achieved by a development step entailing dissolving, melting, or softening by contact with heat, vapors, partial solvents, as well as combinations thereof. Examples of suitable softenable materials include styrene-acrylic copolymers, such as styrene-hexylmethacrylate copolymers. styrene acrylate copolymers, styrene butylmethacrylate copolymers, styrene butylacrylate ethylacrylate copolymers, styrene ethylacrylate acrylic acid copolymers, and the like, polystyrenes, including polyalphamethyl styrene, alkyd substituted polystyrenes, styrene-olefin copolymers, styrene-vinyltoluene copolymers, polyesters, polyurethanes, polycarbonates, polyterpenes, silicone elastomers, mixtures thereof, copolymers thereof, and the like, as well as any other suitable materials as disclosed, for example, in U.S. Pat. No. 3,975,195 and other U.S. patents directed to migration imaging members which have been incorporated herein by reference. The softenable layer can be of any effective thickness, typically from about 0.5 to about 30 microns, preferably from about 1 to about 25 microns, and more preferably from about 2 to about 10 microns, although the thickness can be outside these ranges. The softenable layer can be applied to the conductive layer by any suitable coating process. Typical coating processes include draw bar coating, spray coating, extrusion, dip coating, gravure roll coating, wire-wound rod coating, air knife coating and the like.

The softenable layer also contains migration marking material. The migration marking material can be electrically photosensitive, photoconductive, or of any other suitable combination of materials, or possess any other desired physical property and still be suitable for use in the migration imaging members of the present invention. The migration marking materials preferably are particulate, wherein the particles are closely spaced from each other. Preferred migration marking materials generally are spherical in shape and submicron in size. The migration marking material generally is capable of substantial photodischarge upon electrostatic charging and exposure to activating radiation and is substantially absorbing and opaque to activating radiation in the spectral region where the photosensitive migration marking particles photogenerate charges. The migration marking material is generally present as a thin layer or monolayer of particles situated at or near the surface of the softenable layer spaced from the conductive layer. When present as particles, the particles of migration marking material preferably have an average diameter of up to 2 microns, and more preferably of from about 0.1 to about 1 micron. The layer of migration marking particles is situated at or near that surface of the softenable layer spaced from or most distant from the conductive layer. Preferably, the particles are situated at a distance of from about 0.01 to 0.1 micron from the layer surface, and more preferably from about 0.02 to 0.08 micron from the layer surface. Preferably, the particles are situated at a distance of from about 0.005 to about 0.2 micron from each other, and more preferably at a distance of from about 0.05 to about 0.1 micron from each other, the distance being measured between the closest edges of the particles, i.e. from outer diameter to outer diameter. The migration marking material contiguous to the outer surface of the softenable layer is present in any effective amount, preferably from about 5 to about 80 percent by total weight of the softenable layer, and more preferably from about 25 to about 80 percent by total weight of the softenable layer, although the amount can be outside of this range.

Examples of suitable migration marking materials include selenium, alloys of selenium with alloying components such as tellurium, arsenic, antimony, thallium, bismuth, or mixtures thereof, selenium and alloys of selenium doped with halogens, as disclosed in, for example, U.S. Pat. No. 3,312,548, the disclosure of which is totally incorporated herein by reference, and the like, phthalocyanines, and any other suitable materials as disclosed, for example, in U.S. Pat. No. 3,975,195 and other U.S. patents directed to migration imaging members and incorporated herein by reference.

If desired, two or more softenable layers, each containing migration marking particles, can be present in the imaging member as disclosed in copending application U.S. Ser. No. 08/353,461 pending, filed Dec. 9, 1994, entitled "Improved Migration Imaging Members," with the named inventors Edward G. Zwartz, Carol A. Jennings, Man C. Tam, Philip H. Soden, Arthur Y. Jones, Arnold L. Pundsack, Enrique Levy, Ah-Mee Hor, and William W. Limburg, the disclosure of which is totally incorporated herein by reference.

The softenable layer of the migration imaging member contains a charge transport material. The charge transport material can be any suitable charge transport material either capable of acting as a softenable layer material or capable of being dissolved or dispersed on a molecular scale in the softenable layer material. When a charge transport material is also contained in another layer in the imaging member, preferably there is continuous transport of charge through the entire film structure. The charge transport material is defined as a material which is capable of improving the charge injection process for one sign of charge from the migration marking material into the softenable layer and also of transporting that charge through the softenable layer. The charge transport material can be either a hole transport material (transports positive charges) or an electron transport material (transports negative charges). The sign of the charge used to sensitize the migration imaging member during imaging can be of either polarity. Charge transporting materials are well known in the art. Typical charge transporting materials include the following:

Diamine transport molecules of the type described in U.S. Pat. Nos. 4,306,008, 4,304,829, 4,233,384, 4,115,116, 4,299,897, and 4,081,274, the disclosures of each of which are totally incorporated herein by reference. Typical diamine transport molecules include N,N'-diphenyl-N,N'-bis(3"-methylphenyl)-(1,1'-biphenyl)-4,4'-diamine, N,N'-diphenyl-N,N'-bis(4-methylphenyl)-(1,'-biphenyl)-4,4'-diamine, N,N'-diphenyl-N,N'-bis(2-methylphenyl)-(1,1'-biphenyl)-4,4'-diamine, N,N'-diphenyl-N,N'-bis(3-ethylphenyl)-(1,1'-biphenyl)-4,4'-diamine, N,N'-diphenyl-N,N'-bis(4-ethylphenyl)-(1,1'-biphenyl)-4,4'-diamine, N,N'-diphenyl-N,N'-bis(4 -n-butylphenyl)-(1,'-biphenyl)-4,4'-diamine, N,N'-diphenyl-N,N'-bis(3-chlorophenyl)-[1,1'-biphenyl]-4,4'-diamine, N,N'-diphenyl-N,N'-bis(4-chlorophenyl)-[1,1'-biphenyl]-4,4'-diamine, N,N'-diphenyl-N,N'-bis(phenylmethyl)-[1,1'-biphenyl]-4,4'-diamine, N,N,N',N'-tetraphenyl-[2,2'-dimethyl-1,1'-biphenyl]-4,4'-diamine, N,N,N',N'-tetra-(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like.

Pyrazoline transport molecules as disclosed in U.S. Pat. Nos. 4,315,982, 4,278,746, and 3,837,851, the disclosures of each of which are totally incorporated herein by reference. Typical pyrazoline transport molecules include 1-[lepidyl-(2)]-3-(p-diethylaminophenyl)-5-(p-diethylaminophenyl)pyrazoline, 1-[quinolyl-(2)]-3-(p-diethylaminophenyl)-5-(p-diethylaminophenyl)pyrazoline, 1-[pyridyl(2)]-3-(p-diethylaminostyryl)-5-(p-diethylaminophenyl)pyrazoline, 1-[6-methoxypyridyl-(2)]-3-(p-diethylaminostyryl)-5-(p-diethylaminophenyl) pyrazoline, 1-phenyl-3-[p-dimethylaminostyryl]-5-(p-dimethylaminostyryl)pyrazoline, 1-phenyl-3-[p-diethylaminostyryl]-5-(p-diethylaminostyryl)pyrazoline, and the like.

Substituted fluorene charge transport molecules as described in U.S. Pat. No. 4,245,021, the disclosure of which is totally incorporated herein by reference. Typical fluorene charge transport molecules include 9-(4'-dimethylaminobenzylidene)fluorene, 9-(4'-methoxybenzylidene)fluorene, 9-(2',4'-dimethoxybenzylidene)fluorene, 2-nitro-9-benzylidene-fluorene,2-nitro-9-(4'-diethylaminobenzylidene)fluorene, and the like.

Oxadiazole transport molecules such as 2,5-bis(4-diethylaminophenyl)-1,3,4-oxadiazole, pyrazoline, imidazole, triazole, and the like. Other typical oxadiazole transport molecules are described, for example, in German Patent 1,058,836, German Patent 1,060,260, and German Patent 1,120,875, the disclosures of each of which are totally incorporated herein by reference.

Hydrazone transport molecules, such as p-diethylamino benzaldehyde-(diphenylhydrazone), o-ethoxy-p-diethylaminobenzaldehydeo-(diphenylhydrazone), o-methyl-p-diethylaminobenzaldehyde-(diphenylhydrazone), o-methyl-p-dimethylaminobenzaldehyde-(diphenylhydrazone), 1-naphthalenecarbaldehyde 1-methyl-1-phenylhydrazone, 1-naphthalenecarbaldehyde 1,1-phenylhydrazone, 4-methoxynaphthlene-1-carbaldeyde 1-methyl-1-phenylhydrazone, and the like. Other typical hydrazone transport molecules are described, for example in U.S. Pat. Nos. 4,150,987, 4,385,106, 4,338,388, and 4,387,147, the disclosures of each of which are totally incorporated herein by reference.

Carbazole phenyl hydrazone transport molecules such as 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and the like. Other typical carbazole phenyl hydrazone transport molecules are described, for example, in U.S. Pat. Nos. 4,256,821 and 4,297,426, the disclosures of each of which are totally incorporated herein by reference.

Vinyl-aromatic polymers such as polyvinyl anthracene, polyacenaphthylene; formaldehyde condensation products with various aromatics such as condensates of formaldehyde and 3-bromopyrene; 2,4,7-trinitrofluorenone, and 3,6-dinitro-N-t-butylnaphthalimide as described, for example, in U.S. Pat. No. 3,972,717, the disclosure of which is totally incorporated herein by reference.

Oxadiazole derivatives such as 2,5-bis-(p-diethylaminophenyl)-oxadiazole-1,3,4 described in U.S. Pat. No. 3,895,944, the disclosure of which is totally incorporated herein by reference.

Tri-substituted methanes such as alkyl-bis(N,N-dialkylaminoaryl)methane, cycloalkyl-bis(N,N-dialkylaminoaryl-)methane, and cycloalkenyl-bis(N,N-dialkylaminoaryl-)methane as described in U.S. Pat. No. 3,820,989, the disclosure of which is totally incorporated herein by reference.

9-Fluorenylidene methane derivatives having the formula

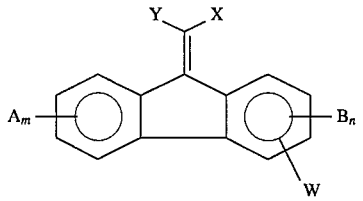

wherein X and Y are cyano groups or alkoxycarbonyl groups; A, B, and W are electron withdrawing groups independently selected from the group consisting of acyl, alkoxycarbonyl, nitro, alkylaminocarbonyl, and derivatives thereof; m is a number of from 0 to 2; and n is the number 0 or 1 as described in U.S. Pat. No. 4,474,865, the disclosure of which is totally incorporated herein by reference. Typical 9-fluorenylidene methane derivatives encompassed by the above formula include (4-n-butoxycarbonyl-9-fluorenylidene)malonontrile, (4-phenethoxycarbonyl-9-fluorenylidene)malonontrile, (4-carbitoxy-9-fluorenylidene)malonontrile, (4-n-butoxycarbonyl-2,7-dinitro-9-fluorenylidene)malonate, and the like.

Other charge transport materials include poly-1-vinylpyrene, poly-9-vinylanthracene, poly-9-(4-pentenyl)-carbazole, poly-9-(5-hexyl)carbazole, polymethylene pyrene, poly-1-(pyrenyl)-butadiene, polymers such as alkyl, nitro, amino, halogen, and hydroxy substitute polymers such as poly-3-amino carbazole, 1,3-dibromo-poly-N-vinyl carbazole, 3,6-dibromo-poly-N-vinyl carbazole, and numerous other transparent organic polymeric or non-polymeric transport materials as described in U.S. Pat. No. 3,870,516, the disclosure of which is totally incorporated herein by reference. Also suitable as charge transport materials are phthalic anhydride, tetrachlorophthalic anhydride, benzil, mellitic anhydride, S-tricyanobenzene, picryl chloride, 2,4-dinitrochlorobenzene, 2,4-dinitrobromobenzene, 4-nitrobiphenyl, 4,4-dinitrophenyl, 2,4,6-trinitroanisole, trichlorotrinitrobenzene, trinitro-O-toluene, 4,6-dichloro-1,3 -dinitrobenzene, 4,6-dibromo-1,3-dinitrobenzene, P-dinitrobenzene, chloranil, bromanil, and mixtures thereof, 2,4,7-trinitro-9-fluorenone, 2,4,5,7-tetranitrofluorenone, trinitroanthracene, dinitroacridene, tetracyanopyrene, dinitroanthraquinone, polymers having aromatic or heterocyclic groups with more than one strongly electron withdrawing substituent such as nitro, sulfonate, carboxyl, cyano, or the like, including polyesters, polysiloxanes, polyamides, polyurethanes, and epoxies, as well as block, graft, or random copolymers containing the aromatic moiety, and the like, as well as mixtures thereof, as described in U.S. Pat. No. 4,081,274, the disclosure of which is totally incorporated herein by reference.

Also suitable are charge transport materials such as triarylamines, including tritolylamine, of the formula

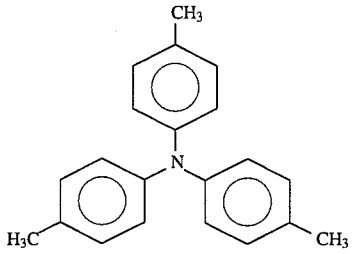

and the like, as disclosed in, for example, U.S. Pat. Nos. 3,240,597 and 3,180,730, the disclosures of which are totally incorporated herein by reference, and substituted diarylmethane and triarylmethane compounds, including bis-(4-diethylamino-2-methylphenyl)-phenylmethane, of the formula and the like, as disclosed in, for example, U.S. Pat. Nos. 4,082,551, 3,755,310, 3,647,431, British Patent 984,965, British Patent 980,879, and British Patent 1,141,666, the disclosures of which are totally incorporated herein by reference.

When the charge transport molecules are combined with an insulating binder to form the softenable layer, the amount of charge

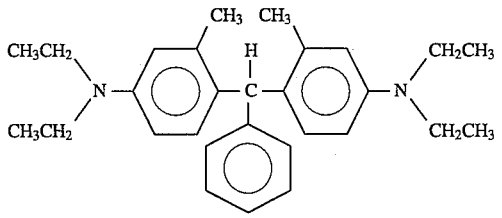

transport molecule which is used can vary depending upon the particular charge transport material and its compatibility (e.g. solubility) in the continuous insulating film forming binder phase of the softenable matrix layer and the like. Satisfactory results have been obtained using between about 5 percent to about 50 percent by weight charge transport molecule based on the total weight of the softenable layer. A particularly preferred charge transport molecule is one having the general formula

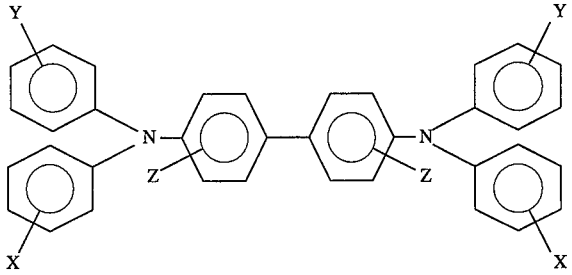

wherein X, Y and Z are selected from the group consisting of hydrogen, an alkyl group having from 1 to about 20 carbon atoms and chlorine, and at least one of X, Y and Z is independently selected to be an alkyl group having from 1 to about 20 carbon atoms or chlorine. If Y and Z are hydrogen, the compound can be named N,N'-diphenyl-N,N'-bis(alkylphenyl)-[1,1'-biphenyl]-4,4'-diamine wherein the alkyl is, for example, methyl, ethyl, propyl, n-butyl, or the like, or the compound can be N,N'-diphenyl-N,N'-bis(chlorophenyl)-[1,1'-biphenyl]-4,4'-diamine. Good results can be obtained when the softenable layer contains between about 5 percent to about 40 percent by weight of these diamine compounds based on the total weight of the softenable layer. Optimum results are achieved when the softenable layer contains between about 8 percent to about 32 percent by weight of N,N'-diphenyl-N,N'-bis(3"-methylphenyl)-(1,1'-biphenyl)-4,4'-diamine based on the total weight of the softenable layer.

The charge transport material is present in the softenable material in any effective amount, typically from about 5 to about 50 percent by weight and preferably from about 8 to about 40 percent by weight, although the amount can be outside these ranges. Alternatively, the softenable layer can employ the charge transport material as the softenable material if the charge transport material possesses the necessary film-forming characteristics and otherwise functions as a softenable material. The charge transport material can be incorporated into the softenable layer by any suitable technique. For example, it can be mixed with the softenable layer components by dissolution in a common solvent. If desired, a mixture of solvents for the charge transport material and the softenable layer material can be employed to facilitate mixing and coating. The charge transport molecule and softenable layer mixture can be applied to the substrate by any conventional coating process. Typical coating processes include draw bar coating, spray coating, extrusion, dip coating, gravure roll coating, wire-wound rod coating, air knife coating, and the like.

The optional adhesive layer can include any suitable adhesive material. Typical adhesive materials include copolymers of styrene and an acrylate, polyester resin such as DuPont 49000 (available from E.I. duPont de Nemours Company), copolymer of acrylonitrile and vinylidene chloride, polyvinyl acetate, polyvinyl butyral and the like and mixtures thereof. The adhesive layer can have any thickness, typically from about 0.05 to about 1 micron, although the thickness can be outside of this range. When an adhesive layer is employed, it preferably forms a uniform and continuous layer having a thickness of about 0.5 micron or less to ensure satisfactory discharge during the imaging process. It can also optionally include charge transport molecules.

The optional charge transport layer can comprise any suitable film forming binder material. Typical film forming binder materials include styrene acrylate copolymers, polycarbonates, co-polycarbonates, polyesters, co-polyesters, polyurethanes, polyvinyl acetate, polyvinyl butyral, polystyrenes, alkyd substituted polystyrenes, styrene-olefin copolymers, styrene-co-n-hexylmethacrylate, an 80/20 mole percent copolymer of styrene and hexylmethacrylate having an intrinsic viscosity of 0.179 dl/gm; other copolymers of styrene and hexylmethacrylate, styrene-vinyltoluene copolymers, polyalpha-methylstyrene, mixtures thereof, and copolymers thereof. The above group of materials is not intended to be limiting, but merely illustrative of materials suitable as film forming binder materials in the optional charge transport layer. The film forming binder material typically is substantially electrically insulating and does not adversely chemically react during the imaging process. Although the optional charge transport layer has been described as coated on a substrate, in some embodiments, the charge transport layer itself can have sufficient strength and integrity to be substantially self supporting and can, if desired, be brought into contact with a suitable conductive substrate during the imaging process. As is well known in the art, a uniform deposit of electrostatic charge of suitable polarity can be substituted for a conductive layer. Alternatively, a uniform deposit of electrostatic charge of suitable polarity on the exposed surface of the charge transport spacing layer can be substituted for a conductive layer to facilitate the application of electrical migration forces to the migration layer. This technique of "double charging" is well known in the art. The charge transport layer is of any effective thickness, typically from about 1 to about 25 microns, and preferably from about 2 to about 20 microns, although the thickness can be outside these ranges.

Charge transport molecules suitable for the charge transport layer are described in detail hereinabove. The specific charge transport molecule utilized in the charge transport layer of any given imaging member can be identical to or different from the charge transport molecule employed in the adjacent softenable layer. Similarly, the concentration of the charge transport molecule utilized in the charge transport spacing layer of any given imaging member can be identical to or different from the concentration of charge transport molecule employed in the adjacent softenable layer. When the charge transport material and film forming binder are combined to form the charge transport spacing layer, the amount of charge transport material used can vary depending upon the particular charge transport material and its compatibility (e.g. solubility) in the continuous insulating film forming binder. Satisfactory results have been obtained using between about 5 percent and about 50 percent based on the total weight of the optional charge transport spacing layer, although the amount can be outside this range. The charge transport material can be incorporated into the charge transport layer by techniques similar to those employed for the softenable layer.

The optional charge blocking layer can be of various suitable materials, provided that the objectives of the present invention are achieved, including aluminum oxide, polyvinyl butyral, silane and the like, as well as mixtures thereof. This layer, which is generally applied by known coating techniques, is of any effective thickness, typically from about 0.05 to about 1 micron, and preferably from about 0.05 to about 0.5 micron. Typical coating processes include draw bar coating, spray coating, extrusion, dip coating, gravure roll coating, wire-wound rod coating, air knife coating and the like.

The infrared or red light sensitive layer generally comprises a pigment sensitive to infrared and/or red light radiation. While the infrared or red light sensitive pigment may exhibit some photosensitivity in the wavelength to which the migration marking material is sensitive, it is preferred that photosensitivity in this wavelength range be minimized so that the migration marking material and the infrared or red light sensitive pigment exhibit absorption peaks in distinct, different wavelength regions. This pigment can be deposited as the sole or major component of the infrared or red light sensitive layer by any suitable technique, such as vacuum evaporation or the like. An infrared or red light sensitive layer of this type can be formed by placing the pigment and the imaging member comprising the substrate and any previously coated layers into an evacuated chamber, followed by heating the infrared or red light sensitive pigment to the point of sublimation. The sublimed material recondenses to form a solid film on the imaging member. Alternatively, the infrared or red light sensitive pigment can be dispersed in a polymeric binder and the dispersion coated onto the imaging member to form a layer. Examples of suitable red light sensitive pigments include perylene pigments such as benzimidazole perylene, dibromoanthranthrone, crystalline trigonal selenium, beta-metal free phthalocyanine, azo pigments, and the like, as well as mixtures thereof. Examples of suitable infrared sensitive pigments include X-metal free phthalocyanine, metal phthalocyanines such as vanadyl phthalocyanine, chloroindium phthalocyanine, titanyl phthalocyanine, chloroaluminum phthalocyanine, copper phthalocyanine, magnesium phthalocyanine, and the like, squaraines, such as hydroxy squaraine, and the like as well as mixtures thereof. Examples of suitable optional polymeric binder materials include polystyrene, styrene-acrylic copolymers, such as styrene-hexylmethacrylate copolymers, styrene-vinyl toluene copolymers, polyesters, such as PE-200, available from Goodyear, polyurethanes, polyvinylcarbazoles, epoxy resins, phenoxy resins, polyamide resins, polycarbonates, polyterpenes, silicone elastomers, polyvinylalcohols, such as Gelvatol 20-90, 9000, 20-60, 6000, 20-30, 3000, 40-20, 40-10, 26-90, and 30-30, available from Monsanto Plastics and Resins Co., St. Louis, Mo., polyvinyiformals, such as Formvar 12/85, 5/95E, 6/95E, 7/95E, and 15/95E, available from Monsanto Plastics and Resins Co., St. Louis, Mo., polyvinylbutyrals, such as Butvar B-72, B-74, B-73, B-76, B-79, B-90, and B-98, available from Monsanto Plastics and Resins Co., St. Louis, Mo., Zeneca resin A622, available from Zeneca Colours, Wilmington, Del., and the like as well as mixtures thereof. When the infrared or red light sensitive layer comprises both a polymeric binder and the pigment, the layer typically comprises the binder in an amount of from about 5 to about 95 percent by weight and the pigment in an amount of from about 5 to about 95 percent by weight, although the relative amounts can be outside this range. Preferably, the infrared or red light sensitive layer comprises the binder in an amount of from about 40 to about 90 percent by weight and the pigment in an amount of from about 10 to about 60 percent by weight. Optionally, the infrared sensitive layer can contain a charge transport material as described herein when a binder is present; when present, the charge transport material is generally contained in this layer in an amount of from about 5 to about 30 percent by weight of the layer. The optional charge transport material can be incorporated into the infrared or red light radiation sensitive layer by any suitable technique. For example, it can be mixed with the infrared or red light radiation sensitive layer components by dissolution in a common solvent. If desired, a mixture of solvents for the charge transport material and the infrared or red light sensitive layer material can be employed to facilitate mixing and coating. The infrared or red light radiation sensitive layer mixture can be applied to the substrate by any conventional coating process. Typical coating processes include draw bar coating, spray coating, extrusion, dip coating, gravure roll coating, wire-wound rod coating, air knife coating, and the like. An infrared or red light sensitive layer wherein the pigment is present in a binder can be prepared by dissolving the polymer binder in a suitable solvent, dispersing the pigment in the solution by ball milling, coating the dispersion onto the imaging member comprising the substrate and any previously coated layers, and evaporating the solvent to form a solid film. When the infrared or red light sensitive layer is coated directly onto the softenable layer containing migration marking material, preferably the selected solvent is capable of dissolving the polymeric binder for the infrared or red sensitive layer but does not dissolve the softenable polymer in the layer containing the migration marking material. One example of a suitable solvent is isobutanol with a polyvinyl butyral binder in the infrared or red sensitive layer and a styrene/ethyl acrylate/acrylic acid terpolymer softenable material in the layer containing migration marking material. The infrared or red light sensitive layer can be of any effective thickness. Typical thicknesses for infrared or red light sensitive layers comprising a pigment and a binder are from about 0.05 to about 2 microns, and preferably from about 0.1 to about 1.5 microns, although the thickness can be outside these ranges. Typical thicknesses for infrared or red light sensitive layers consisting of a vacuum-deposited layer of pigment are from about 200 to about 2,000 Angstroms, and preferably from about 300 to about 1,000 Angstroms, although the thickness can be outside these ranges.

The optional overcoating layer can be substantially electrically insulating, or have any other suitable properties. The overcoating preferably is substantially transparent, at least in the spectral region where electromagnetic radiation is used for imagewise exposure step in the imaging process. The overcoating layer is continuous and preferably of a thickness up to about 3 microns. More preferably, the overcoating has a thickness of between about 0.1 and about 2 micron to minimize residual charge buildup. Overcoating layers greater than about 2 or 3 microns thick can also be used. Typical overcoating materials include acrylic-styrene copolymers, methacrylate polymers, methacrylate copolymers, styrene-butylmethacrylate copolymers, butylmethacrylate resins, vinylchloride copolymers, fluorinated homo or copolymers, high molecular weight polyvinyl acetate, organosilicon polymers and copolymers, polyesters, polycarbonates, polyamides, polyvinyl toluene and the like. The overcoating layer generally protects the softenable layer to provide greater resistance to the adverse effects of abrasion during handling and imaging. The overcoating layer preferably adheres strongly to the softenable layer to minimize damage. The overcoating layer can also have abhesive properties at its outer surface which provide improved resistance to toner filming during toning, transfer, and/or cleaning. The abhesive properties can be inherent in the overcoating layer or can be imparted to the overcoating layer by incorporation of another layer or component of abhesive material. These abhesive materials should not degrade the film forming components of the overcoating and preferably have a surface energy of less than about 20 ergs/cm$^2$. Typical abhesive materials include fatty acids, salts and esters, fluorocarbons, silicones, and the like. The coatings can be applied by any suitable technique such as draw bar, spray, dip, melt, extrusion or gravure coating. It will be appreciated that these overcoating layers protect the imaging member before imaging, during imaging, and after the members have been imaged.

Figure 2A:
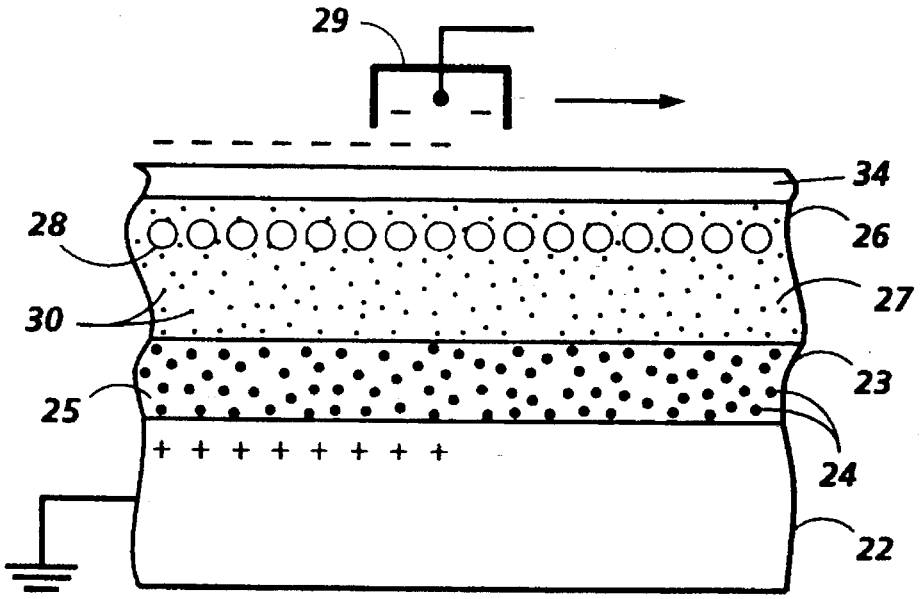
FIGS. 2A, 2B, 3A, 3B, 4A, and 4B illustrate schematically processes for presensitizing a migration imaging member according to the present invention.
Figure 2B:
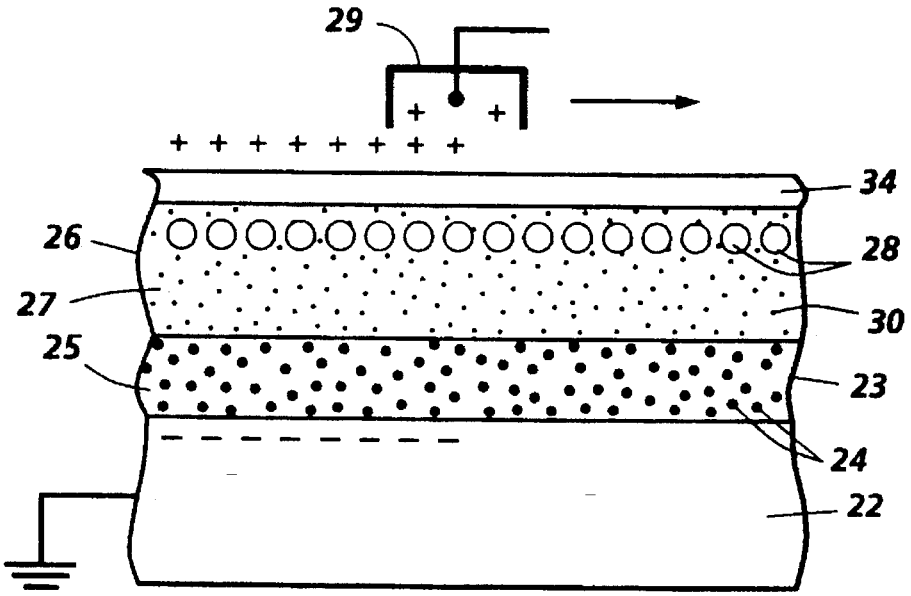

A process for presensitizing, imaging, and developing a migration imaging member according to the process of the present invention is illustrated schematically in FIGS. 2A and 2B through 6. In the process steps illustrated in FIGS. 2A, 3A, and 4A, the imaging member is initially charged to a polarity opposite to that which the charge transport material in the softenable layer is capable of transporting; in the process steps illustrated in FIGS. 2B, 3B, and 4B, the imaging member is initially charged to the same polarity as that which the charge transport material in the softenable layer is capable of transporting. FIGS. 2A and 2B through 6 illustrate schematically a migration imaging member comprising a conductive substrate layer 22 that is connected to a reference potential such as a ground, an infrared or red light sensitive layer 23 comprising infrared or red light sensitive pigment particles 24 dispersed in optional polymeric binder 25, a softenable layer 26 comprising softenable material 27, migration marking material 28, and charge transport material 30 (in the embodiments illustrated, a hole transporting material), and electrically insulating overcoating layer 34. As illustrated in FIGS. 2A and 2B, the member is uniformly charged in the dark to either polarity (negative charging is illustrated in FIG. 2A, positive charging is illustrated in FIG. 2B) by a charging means 29 such as a corona charging apparatus.

Figure 3A:
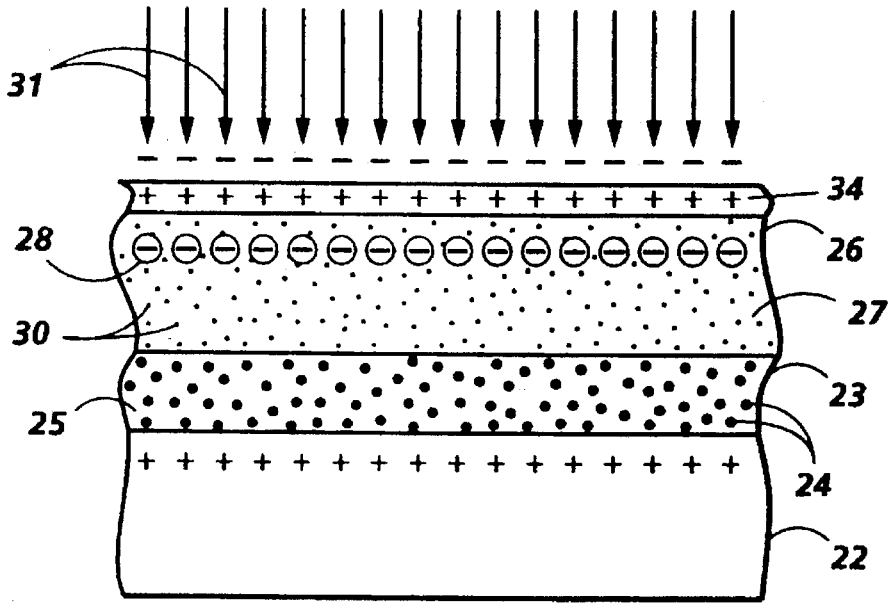
Figure 3B:
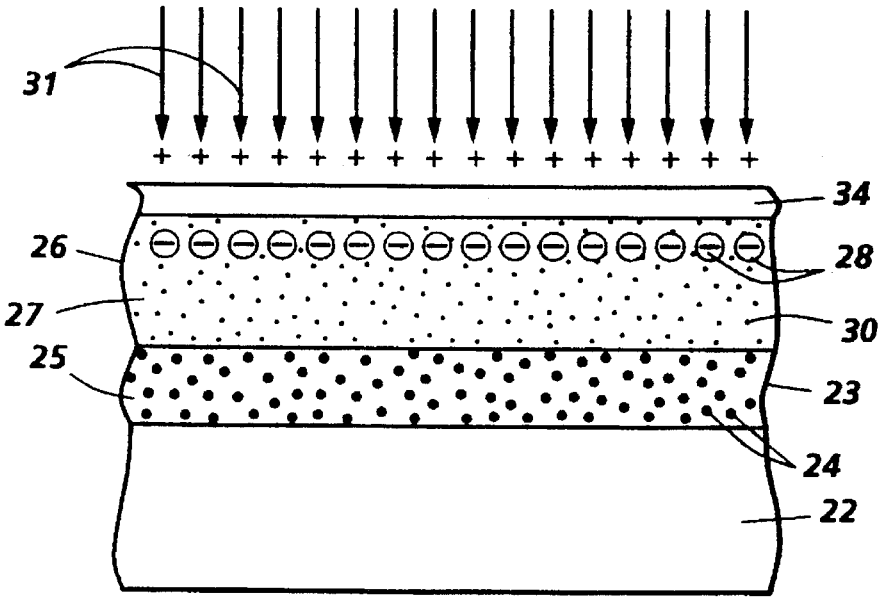

As illustrated schematically in FIGS. 3A and 3B, the charged member is subsequently exposed uniformly to activating radiation 31 at a wavelength to which the migration marking material 28 is sensitive. For example, when the migration marking material is selenium particles, blue or green light can be used for uniform exposure. The uniform exposure to radiation 31 results in absorption of radiation by the migration marking material 28. As shown in FIG. 3A, the migration marking particles 28 acquire a negative charge as ejected holes (positive charges) discharge the surface negative charges. When no overcoat is present, the ejected holes migrate through the softenable layer to discharge substantially the negative surface charge. When an overcoat is present, the ejected holes become substantially trapped at the interface between softenable layer 26 and overcoating layer 34. As shown in FIG. 3B, uniform exposure to activating radiation 31 at a wavelength to which the migration marking material 28 is sensitive results in photogeneration of electron-hole pairs in the migration marking material 28. The photogenerated holes are injected out of the migration marking material 28, leaving migration marking material 28 negatively charged. The injected holes migrate through softenable layer 26 (which contains hole transport material 30) to neutralize the charge in the substrate, thereby generating an electric field between the negatively charged migration marking material 28 and the positive charge on the surface of overcoating layer 34.

Figure 4A:
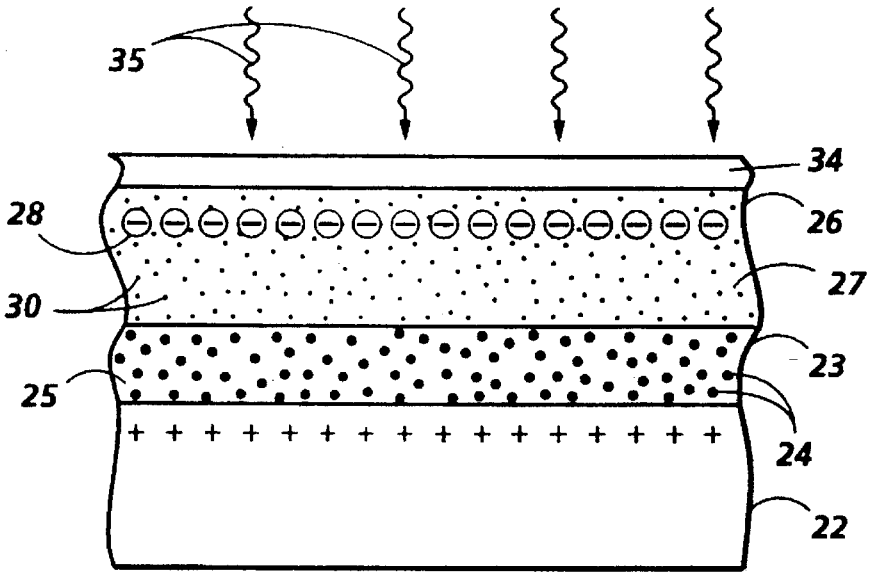
Figure 4B:
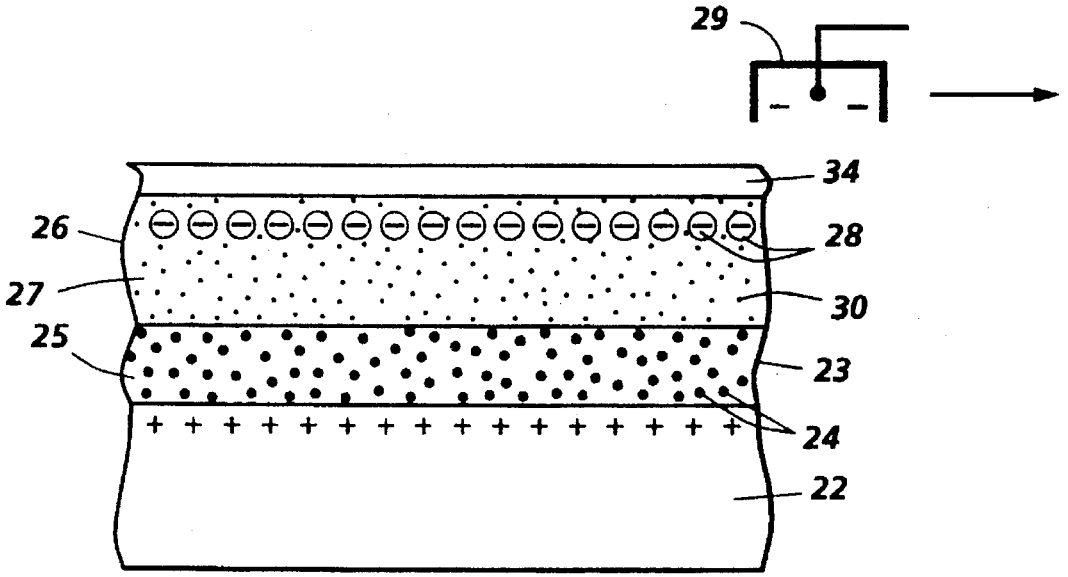

Thereafter, as illustrated schematically in FIGS. 4A and 4B, the surface charge on the surface of overcoating layer 34 spaced from substrate 22 is neutralized. As illustrated in FIG. 4A, the migration imaging member is subjected to gentle heat energy 35, which enables neutralization of the surface charge. For migration imaging members without an overcoat, heating further ensures the transport of ejected charges to the surface to neutralize the surface charge, especially when the migration imaging members are to be sensitized and rolled up in roll form or stacked up in cut sheets in a high speed operation. For migration imaging members with an overcoat, heating causes the trapped charges to de-trap and transport to the surface of the overcoat to neutralize the negative charge. Since the charge is now in the migration marking material instead of on the surface, the migration imaging members can be rolled up into rolls or stacked up in cut sheets or otherwise handled without detriment to their subsequent image formation abilities. The heating temperature is well below the temperature required to soften the softenable material 27, typically being from about 10° to about 40° C. below the development temperature and preferably from about 15° to about 35° C. below the development temperature, although the temperature can be outside these ranges. For example, when a styrene/ethyl acrylate/acrylic acid terpolymer is employed as the softenable material and the development temperature is from about 100° C. to about 130° C., typical heating temperatures in this step are from about 50° to about 115° C., and preferably from about 55° to about 110° C., although the temperature can be outside these ranges. As illustrated in FIG. 4B, the migration imaging member is subjected to uniform negative recharging with a charging means 29 such as a corona charging apparatus. Negative recharging reverses the charge polarity so that the surface charge is neutralized and an electric field is generated between the charged migration marking material 28 and the substrate 22. In both the embodiment illustrated in FIG. 4A and the embodiment illustrated in FIG. 4B, the resulting presensitized or precharged imaging member retains its stable charge, and hence its red or infrared imaging sensitivity, for very long periods of time (typically at least 1 year or more, and in some instances believed to be about 3 years or more).

Figure 5:
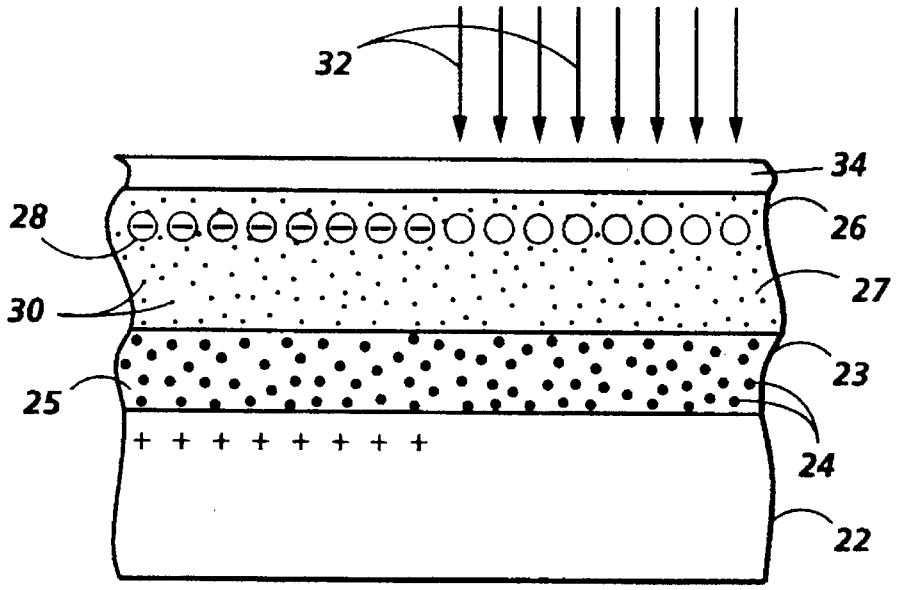
FIG. 5 illustrates schematically a process for imagewise exposing a presensitized migration imaging member with infrared or red light radiation according to the present invention.

Process steps 2A or 2B through 4A or 4B can be carried out well in advance of subsequent imaging steps 5 and 6 because of the exceedingly long stability of the charge in the migration marking material 28. Accordingly, if desired, process steps 2A or 2B through 4A or 4B can be carried out by the manufacturer prior to delivery of the migration imaging member to the customer. Process steps 5 and 6 can then be carried out by the customer on any conventional infrared or red light radiation imaging equipment, such as the equipment commonly employed to image silver halide films, without any need to modify the imaging equipment. Alternatively, the migration imaging member can be delivered to the customer in its unsensitized condition, and the customer can carry out process steps 2A or 2B through 4A or 4B with a presensitizing apparatus separate from the imaging apparatus. Typically, in the process of the present invention, a period of at least about 2 hours, preferably about 8 hours, and more preferably about 24 hours, takes place between completion of the pre-sensitization process as illustrated in FIGS. 4A and 4B and the imaging process as illustrated in FIG. 5.

As illustrated schematically in FIG. 5, the presensitized migration imaging member is subsequently exposed imagewise to infrared or red light radiation 32. The infrared or red light radiation 32 passes through the non-absorbing migration marking material 28 (which is selected to be insensitive to the infrared or red light radiation wavelength used in this step) and exposes the infrared or red light sensitive pigment particles 24 in the infrared or red light sensitive layer 23, thereby discharging the migration marking particles 28 in areas that are exposed to infrared or red light radiation 32 and leaving the migration marking particles charged in areas that are not exposed to infrared or red light radiation 32.

Figure 6:
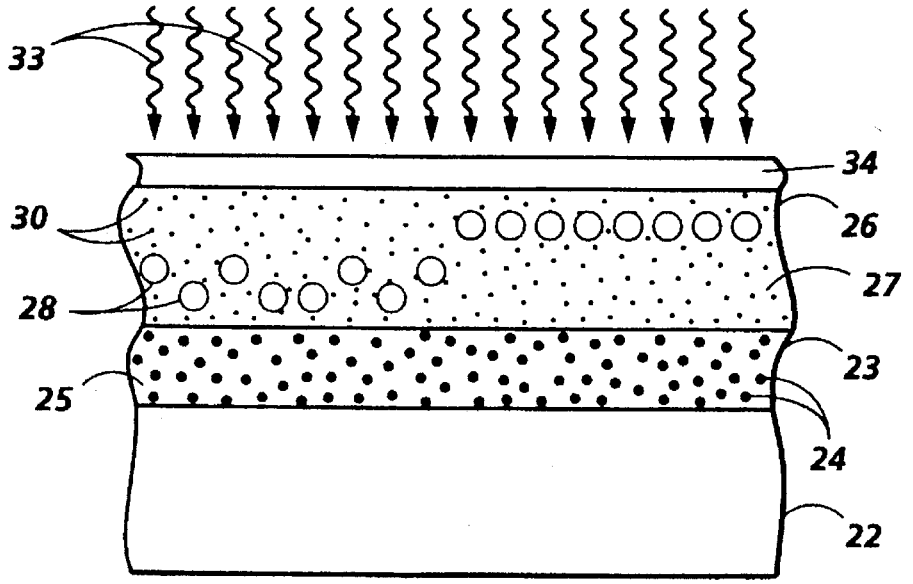
FIG. 6 illustrates schematically a process for developing an imagewise exposed migration imaging member according to the present invention.

Thereafter, as illustrated schematically in FIG. 6, subsequent to formation of a charge image pattern, the imaging member is developed by causing the softenable material to soften by any suitable means (in FIG. 6, by uniform application of heat energy 33 to the member). The heat development temperature and time depend upon factors such as how the heat energy is applied (e.g. conduction, radiation, convection, and the like), the melt viscosity of the softenable layer, thickness of the softenable layer, the amount of heat energy, and the like. For example, at a temperature of 110° C. to about 130° C., heat need only be applied for a few seconds. For lower temperatures, more heating time can be required. When the heat is applied, the softenable material 27 decreases in viscosity, thereby decreasing its resistance to migration of the marking material 28 through the softenable layer 26. In areas of the imaging member wherein the migration marking material 28 has a substantial net charge, upon softening of the softenable material 27, the net charge causes the charged marking material to migrate in image configuration towards the conductive layer 22 and disperse in the softenable layer 26, resulting in a $D_{min}$ area. The uncharged migration marking particles 28 in areas of the imaging member remain essentially neutral and uncharged. Thus, in the absence of migration force, the uncharged migration marking particles remain substantially in their original position in softenable layer 26, resulting in a $D_{max}$ area.

If desired, solvent vapor development can be substituted for heat development. Vapor development of migration imaging members is well known in the art. Generally, if solvent vapor softening is utilized, the solvent vapor exposure time depends upon factors such as the solubility of the softenable layer in the solvent, the type of solvent vapor, the ambient temperature, the concentration of the solvent vapors, and the like.

The application of either heat, or solvent vapors, or combinations thereof, or any other suitable means should be sufficient to decrease the resistance of the softenable material 27 of softenable layer 26 to allow migration of the migration marking material 28 through softenable layer 26 in imagewise configuration. With heat development, satisfactory results can be achieved by heating the imaging member to a temperature of about 100° C. to about 130° C. for only a few seconds when the softenable layer contains an 80/20 mole percent copolymer of styrene and hexylmethacrylate having an intrinsic viscosity of 0.179 dl/gm and N,N'-diphenyl-N,N'-bis(3"-methylphenyl)-(1,1'-biphenyl)-4,4'-diamine. The test for a satisfactory combination of time and temperature is to maximize optical contrast density. With vapor development, satisfactory results can be achieved by exposing the imaging member to the vapor of toluene for between about 4 seconds and about 60 seconds at a solvent vapor partial pressure of between about 5 millimeters and 30 millimeters of mercury when the unovercoated softenable layer contains an 80/20 mole percent copolymer of styrene and hexylmethacrylate having an intrinsic viscosity of 0.179 dl/gm and N,N'-diphenyl-N,N'-bis(3"-methylphenyl)-(1,1'-biphenyl)-4,4'-diamine.

The imaging member illustrated in FIGS. 2A and 2B through 6 is shown without any optional layers such as those illustrated in FIG. 1. If desired, alternative imaging member embodiments, such as those employing any or all of the optional layers illustrated in FIG. 1, can also be employed.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

An infrared-sensitive imaging member is prepared by vacuum sublimation of X-metal-free phthalocyanine (prepared as described in U.S. Pat. No. 3,357,989 (Byrne et al.), the disclosure of which is totally incorporated by reference) placed in a crucible in a vacuum chamber. The temperature of the pigment is raised to a temperature of about 550° C. to deposit it onto a 12 inch wide 100 micron (4 mil) thick Mylar® polyester film (available from E.I. Du Pont de Nemours & Company) having a thin, semi-transparent aluminum coating, resulting in a vacuum deposited layer with a thickness of about 1,000 Angstroms. A solution for the softenable layer is then prepared by dissolving about 42 grams of a terpolymer of styrene/ethylacrylate/acrylic acid (prepared as disclosed in U.S. Pat. No. 4,853,307, the disclosure of which is totally incorporated herein by reference) and about 8 grams of N,N'-diphenyl-N,N'-bis(3"-methylphenyl)-(1,1'-biphenyl)-4,4'-diamine (prepared as disclosed in U.S. Pat. No. 4,265,990, the disclosure of which is totally incorporated herein by reference) in about 450 grams of toluene. The N,N'-diphenyl-N,N'-bis(3"-methylphenyl)-(1,1'-biphenyl)-4,4'-diamine is a charge transport material capable of transporting positive charges (holes). The resulting solution is coated by a solvent extrusion technique onto the infrared sensitive layer and the deposited softenable layer is allowed to dry at about 115° C. for about 2 minutes, resulting in a dried softenable layer with a thickness of about 3 microns. The temperature of the softenable layer is then raised to about 115° C. to lower the viscosity of the exposed surface of the softenable layer to about $5\times10^3$ poises in preparation for the deposition of marking material. A thin layer of particulate vitreous selenium is then applied by vacuum deposition in a vacuum chamber maintained at a vacuum of about $4\times10^{-4}$ Torr. The imaging member is then rapidly chilled to room temperature. A reddish monolayer of selenium particles having an average diameter of about 0.3 micron embedded about 0.05 to 0.1 micron below the exposed surface of the copolymer layer is formed.

The imaging member is then overcoated with a waterborne solution containing about 10 percent by weight of styrene-butyl methacrylate copolymer (ICI Neocryl A622) and about 0.03 percent by weight of polysiloxane resin (Byk 301, available from Byk-Mallinckodt). The dried overcoat has a thickness of about 1 micron.

The migration imaging member thus prepared is then uniformly negatively charged to a surface potential of about −300 volts with a corona charging device. The exposed member is subsequently uniformly exposed to 490 nanometer light and thereafter subjected to a temperature of about 85° C. for about 5 seconds using a hot plate in contact with the polyester. The imaging member is then stored in the dark for 24 hours.

The imaging member is subsequently imagewise exposed by placing a test pattern mask comprising a silver halide image in contact with the imaging member and exposing the member to infrared light of 780 nanometers through the mask and thereafter developed by subjecting it to a temperature of about 115° C. for about 5 seconds using a hot plate in contact with the polyester. It is believed that the developed imaging member will exhibit an optical contrast density of about 1.0, with the optical density of the $D_{max}$ area being about 1.9 and that of the $D_{min}$ area being about 0.9. The $D_{min}$ is due to substantial depthwise migration of the selenium particles toward the aluminum layer in the $D_{min}$ regions of the image.

EXAMPLE II

An infrared-sensitive migration imaging member prepared as described in Example I is uniformly positively charged to a surface potential of about +350 volts with a corona charging device and is subsequently uniformly exposed to 400 nanometer light. The exposed imaging member is then uniformly negatively recharged to a surface potential of about −300 volts. The imaging member is then stored in the dark for 24 hours.

The imaging member is subsequently imagewise exposed by placing a test pattern mask comprising a silver halide image in contact with the imaging member and exposing the member to infrared light of 780 nanometers through the mask and thereafter developed by subjecting it to a temperature of about 115° C. for about 5 seconds using a hot plate in contact with the polyester. It is believed that the developed imaging member will exhibit an optical contrast density of about 1.0, with the optical density of the $D_{max}$ area being about 1.9 and that of the $D_{min}$ area being about 0.9. The $D_{min}$ is due to substantial depthwise migration of the selenium particles toward the aluminum layer in the $D_{min}$ regions of the image.

EXAMPLE III

A red sensitive migration imaging member is prepared as follows. Into 97.5 grams of cyclohexanone (analytical reagent grade, available from British Drug House (BDH)) is dissolved 1.75 grams of Butvar B-72, a polyvinylbutyral resin (available from Monsanto Plastics & Resins Co.). To the solution is added 0.75 grams of benzimidazole perylene (prepared as disclosed in U.S. Pat. No. 4,587,189, column 12, lines 5 to 20, the entire disclosure of said patent being totally incorporated herein by reference) and 100 grams of ⅛ inch diameter stainless steel balls. The dispersion (containing 2.5 percent by weight solids) is ball milled for 24 hours and then hand coated with a #4 wire wound rod onto a 4 mil thick conductive substrate comprising aluminized polyester (Melinex 442, available from Imperial Chemical Industries (ICI), aluminized to 20 percent light transmission). After the material is dried on the substrate at about 80° C. for about 20 seconds, the film thickness of the resulting pigment containing layer is about 0.1 micron.

Subsequently, a solution of 20 percent by weight solids styrene/ethyl acrylate/acrylic acid terpolymer (prepared as disclosed in U.S. Pat. No. 4,853,307, column 40, line 65 to column 41, line 18, the entire disclosure of said patent being totally incorporated herein by reference) in spectro grade toluene (available from Caledon Laboratories) is hand coated onto the pigment containing layer with a #16 wire wound rod. After drying at 80° C. for about 20 seconds, a thermoplastic softenable layer about 3 microns thick is formed.

The coated substrate is then maintained at 115° C. in a chamber evacuated to $1\times10^{-4}$ torr and selenium is evaporated onto the heated thermoplastic softenable layer at 55 micrograms per square centimeter to form a closely packed monolayer structure of selenium particles of about 0.3 microns in diameter just below the surface of the thermoplastic softenable layer.

The prepared imaging member is then overcoated with a water-borne solution containing about 10 percent by weight of styrene-butyl methacrylate copolymer (ICI Neocryl A622) and about 0.03 percent by weight of polysiloxane resin (Byk 301, available from Byk-Mallinckodt). The dried overcoat has a thickness of about 1 micron.

The migration imaging member thus prepared is uniformly negatively charged to a surface potential of about −300 volts with a corona charging device. The exposed member is subsequently uniformly exposed to 490 nanometer light and thereafter subjected to a temperature of about 85° C. for about 5 seconds using a hot plate in contact with the polyester. The imaging member is then stored in the dark for 4 hours.

The imaging member is subsequently imagewise exposed by placing a test pattern mask comprising a silver halide image in contact with the imaging member and exposing the member to infrared light of 780 nanometers through the mask and thereafter developed by subjecting it to a temperature of about 115° C. for about 5 seconds using a hot plate in contact with the polyester. It is believed that the developed imaging member will exhibit an optical contrast density of about 0.85, with the optical density of the $D_{max}$ area being about 1.85 and that of the $D_{min}$ area being about 1.0. The $D_{min}$ is due to substantial depthwise migration of the selenium particles toward the aluminum layer in the $D_{min}$ regions of the image.

EXAMPLE IV

A red sensitive imaging prepared as described in Example III is uniformly positively charged to a surface potential of about +350 volts with a corona charging device and is subsequently uniformly exposed to 400 nanometer light. The exposed imaging member is then uniformly negatively recharged to a surface potential of about −300 volts. The imaging member is then stored in the dark for 4 hours.

The imaging member is subsequently imagewise exposed by placing a test pattern mask comprising a silver halide image in contact with the imaging member and exposing the member to infrared light of 780 nanometers through the mask and thereafter developed by subjecting it to a temperature of about 115° C. for about 5 seconds using a hot plate in contact with the polyester. It is believed that the resulting imaging member will exhibit an optical contrast density of about 0.85, with the optical density of the $D_{max}$ area being about 1.85 and that of the $D_{min}$ area being about 1.0. The $D_{min}$ is due to substantial depthwise migration of the selenium particles toward the aluminum layer in the $D_{min}$ regions of the image.

Other embodiments and modifications of the present invention may occur to those skilled in the art subsequent to a review of the information presented herein; these embodiments and modifications, as well as equivalents thereof, are also included within the scope of this invention.

What is claimed is:

1. A process which comprises (1) providing a migration imaging member comprising a substrate, an infrared or red light radiation sensitive layer comprising a pigment predominantly sensitive to infrared or red light radiation, a softenable layer comprising a softenable material, a charge transport material, and migration marking material predominantly sensitive to radiation at a wavelength other than that to which the infrared or red light sensitive pigment is predominantly sensitive contained at or near the surface of the softenable layer, said infrared or red light radiation sensitive layer being situated between the substrate and the softenable layer, and an overcoating situated on the surface of the softenable layer spaced from the substrate; (2) uniformly charging the imaging member; (3) subsequent to step (2), uniformly exposing the imaging member to activating radiation at a wavelength to which the migration marking material is sensitive; (4) subsequent to step (3), neutralizing charge on the surface of the imaging member spaced from the substrate; (5) subsequent to step (4), exposing the imaging member to infrared or red light radiation at a wavelength to which the infrared or red light radiation sensitive pigment is sensitive in an imagewise pattern, thereby forming an electrostatic latent image on the imaging member, wherein step (5) takes place at least 2 hours after completion of step (4); (6) subsequent to step (5), causing the softenable material to soften, thereby enabling the migration marking material to migrate through the softenable material toward the substrate in an imagewise pattern.

2. A process according to claim 1 wherein the migration marking material is selenium.

3. A process according to claim 1 wherein the infrared or red light radiation sensitive layer contains a charge transport material.

4. A process according to claim 1 wherein the softenable material is caused to soften by the application of heat.

5. A process according to claim 1 wherein charge on the surface of the imaging member is neutralized by uniformly recharging the imaging member to a polarity opposite to the polarity employed to charge the imaging member in step (2).

6. A process according to claim 1 wherein step (5) takes place at least 8 hours after completion of step (4).

7. A process according to claim 1 wherein step (5) takes place at least 24 hours after completion of step (4).

8. A process according to claim 1 wherein the overcoating is electrically insulating.

9. A process according to claim 1 wherein the overcoating has a thickness of from about 0.1 to about 3 microns.

10. A process which comprises (1) providing a migration imaging member comprising a substrate, an infrared or red light radiation sensitive layer comprising a pigment predominantly sensitive to infrared or red light radiation, and a softenable layer comprising a softenable material, a charge transport material, and migration marking material predominantly sensitive to radiation at a wavelength other than that to which the infrared or red light sensitive pigment is predominantly sensitive contained at or near the surface of the softenable layer, said infrared or red light radiation sensitive layer being situated between the substrate and the softenable layer; (2) uniformly charging the imaging member; (3) subsequent to step (2), uniformly exposing the imaging member to activating radiation at a wavelength to which the migration marking material is sensitive; (4) subsequent to step (3), neutralizing charge on the surface of the imaging member spaced from the substrate; (5) subsequent to step (4), exposing the imaging member to infrared or red light radiation at a wavelength to which the infrared or red light radiation sensitive pigment is sensitive in an imagewise pattern, thereby forming an electrostatic latent image on the imaging member, wherein step (5) takes place at least 2 hours after completion of step (4); (6) subsequent to step (5), causing the softenable material to soften, thereby enabling the migration marking material to migrate through the softenable material toward the substrate in an imagewise pattern, wherein charge on the surface of the imaging member is neutralized by heating the imaging member.

11. A process according to claim 10 wherein the imaging member is heated to a temperature of from about 10° to about 40° C. below the heat development temperature of the softenable material.

12. A process according to claim 10 wherein the imaging member is heated to a temperature of from about 15° to about 35° C. below the heat development temperature of the softenable material.

* * * * *